United States Patent [19]

Hubbell et al.

[11] Patent Number: 4,907,638

[45] Date of Patent: Mar. 13, 1990

[54] EVAPORABLE FOAM PATTERN FOR USE IN CASTING A CYLINDER HEAD

[75] Inventors: James C. Hubbell, Fond du Lac; Gordon L. Stiller, Omro; David D. Liegeois, Oshkosh, all of Wis.

[73] Assignee: Brunswick Corporation, Skokie, Ill.

[21] Appl. No.: 281,171

[22] Filed: Dec. 7, 1988

[51] Int. Cl.[4] ..... B22D 7/02

[52] U.S. Cl. ..... 164/45; 164/34; 164/246; 164/249

[58] Field of Search ..... 164/34–36, 164/45, 235, 246, 249

[56] References Cited

U.S. PATENT DOCUMENTS

| | | | |
|---|---|---|---|
| 4,197,899 | 4/1980 | Ernest | 164/45 |
| 4,632,169 | 12/1986 | Osborn et al. | 164/45 |
| 4,640,333 | 2/1987 | Martin et al. | 164/45 |
| 4,640,728 | 2/1987 | Martin et al. | 164/45 |
| 4,657,063 | 4/1987 | Morris | 164/246 |
| 4,777,997 | 10/1988 | Corbett | 164/246 |
| 4,802,447 | 2/1989 | Corbett | 164/45 |

FOREIGN PATENT DOCUMENTS

| | | | |
|---|---|---|---|
| 282744 | 12/1987 | Japan | 164/34 |
| 282745 | 12/1987 | Japan | 164/34 |
| 282746 | 12/1987 | Japan | 164/34 |
| 282747 | 12/1987 | Japan | 164/34 |

*Primary Examiner*—Nicholas P. Godici
*Assistant Examiner*—Edward A. Brown
*Attorney, Agent, or Firm*—Andrus, Sceales, Starke & Sawall

[57] ABSTRACT

An evaporable foam pattern for producing a cast metal head for a multiple cylinder engine. The assembled pattern includes an elongated block of evaporable foam material having opposed inner and outer faces. A plurality of generally circular head recesses are formed in the inner face and define the cylinder heads in the metal casting. The block is also formed with an internal passage including a group of annular chambers that surround the head recesses and channels interconnect adjacent chambers. The block also has an inlet which communicates with one end of the internal passage and an outlet that communicates with the opposite end of the passage. The pattern is composed of a pair of longitudinal pattern sections having abutted edges that are joined together by an adhesive. The heads, as well as the inlet and outlet, are located in one of the pattern sections, while the two sections in combination define the internal passage.

12 Claims, 2 Drawing Sheets

EVAPORABLE FOAM PATTERN FOR USE IN CASTING A CYLINDER HEAD

BACKGROUND OF THE INVENTION

In a multi-cylinder engine, such as a V-6 marine engine, a cylinder head is associated with each bank of cylinders, and in the past the conventional head has been composed of two cast metal sections, including a head section that enclosed the cylinders and an outer cover section that defines with the outer surface of the head section a water cooling passage. In the assembled engine, water from the block is introduced into one end of the cooling passage in the head and discharged from the opposite end of the passage.

In the conventional cylinder head construction, the two sections are individually cast and the mating faces are then machined, holes are drilled and tapped and the cover section is subsequently connected to the head section through a gasket and bolts. The section thickness of the mating surfaces must be increased to provide the necessary gasket width for effective sealing. In addition, holes are drilled in the flange of the head section to receive bolts when assembling the head to the engine block. This procedure is extremely labor sensitive which adds substantially to the overall cost of the engine, and the need for gaskets, bolts and the increased section thickness at the mating surfaces results in a considerable increase in material cost. Moreover, the gasketed joint provides a potential leakage site.

Evaporable foam casting procedures have been used to produce engine blocks and other engine components, particularly those having complex contours. In the evaporable foam casting procedure, a pattern is formed of an evaporable foam material, such as polystyrene, and is identical in configuration to the metal part to be cast. The pattern is placed in a mold and a flowable material, such as sand, is introduced into the mold and surrounds the pattern as well as filling the cavities in the pattern. In the casting process, molten metal is introduced into the mold through a sprue and the heat of the molten metal will vaporize the foam material with the vapor being trapped within the intersticies of the sand, while the molten metal will fill the voids created by vaporization of the pattern to provide a cast metal part which is identical in configuration to the evaporable foam pattern.

SUMMARY OF THE INVENTION

The invention is directed to an evaporable foam pattern to be used for producing a cast metal cylinder head and particularly to a head to be used with a multi-cylinder engine. The assembled pattern is composed of an elongated block of evaporable foam material, such as polystyrene, and has a pair of opposed faces. A plurality of generally circular recesses are formed in one face of the block and define, in the cast metal part, the heads of the cylinders.

The pattern is also formed with an internal passage including a series of annular chambers that surround the head recesses and adjacent chambers are interconnected by channels. An inlet formed in the pattern is connected to one end of the internal passage while an outlet is connected to an opposite end.

In addition, the evaporable foam pattern is formed with a plurality of internal ribs which extend longitudinally of the channels. The ribs act to stiffen the cast metal head and serve as metal feed paths during casting.

The evaporable foam pattern is composed of a pair of longitudinal pattern sections having abutting edges which are joined together by an adhesive. The recesses which define the heads, as well as the inlet and outlet, are located in one of the pattern sections and the internal passage is located between the two pattern sections.

Through use of the evaporable foam pattern of the invention, the entire head can be cast as an integral structure. This eliminates the necessity of casting the head in two separate metal sections, as in the past, and thus avoids the need for machining the mating surfaces of the two metal sections as well as eliminating the need for drilling and tapping bolt holes in the sections. As gaskets and bolts are not required, the material and labor cost is reduced in addition to avoiding potential leakage sites through gasketed surfaces.

The evaporable foam pattern provides greater versatility in design and enables the head to be designed with more uniform wall thickness which in the cast metal head improves the heat transfer to the cooling medium.

In evaporable foam casting processes, the pattern is initially coated with a ceramic wash and the pattern of the invention is designed so that the wash will readily contact all internal and external surfaces and will completely drain from the pattern. Further, the design of the pattern enables the sand to readily flow into and fill the cavities in the pattern prior to casting.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

The drawings illustrate an evaporable foam pattern 1 to be used in casting the metal head of a bank of cylinders of a V-6 marine engine. However, it is contemplated that the pattern of the invention can be employed to cast the head for a variety of single or multi-cylinder engines.

Pattern 1 is formed of an evaporable foam material such as polystyrene or polymethylmethacrylate, and has a configuration identical to the metal part to be cast. Thus the description of the pattern will be in reference to the metal casting produced through use of the pattern.

Figure 1:
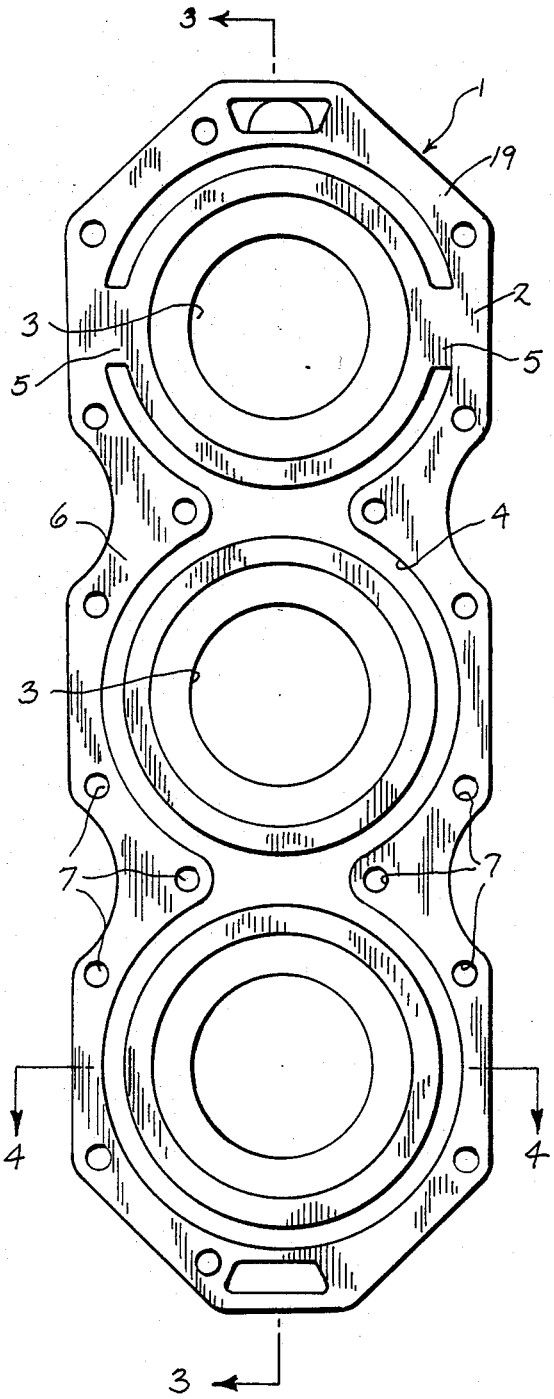
FIG. 1 is a plan view of the inner face of the pattern.
Figure 2:
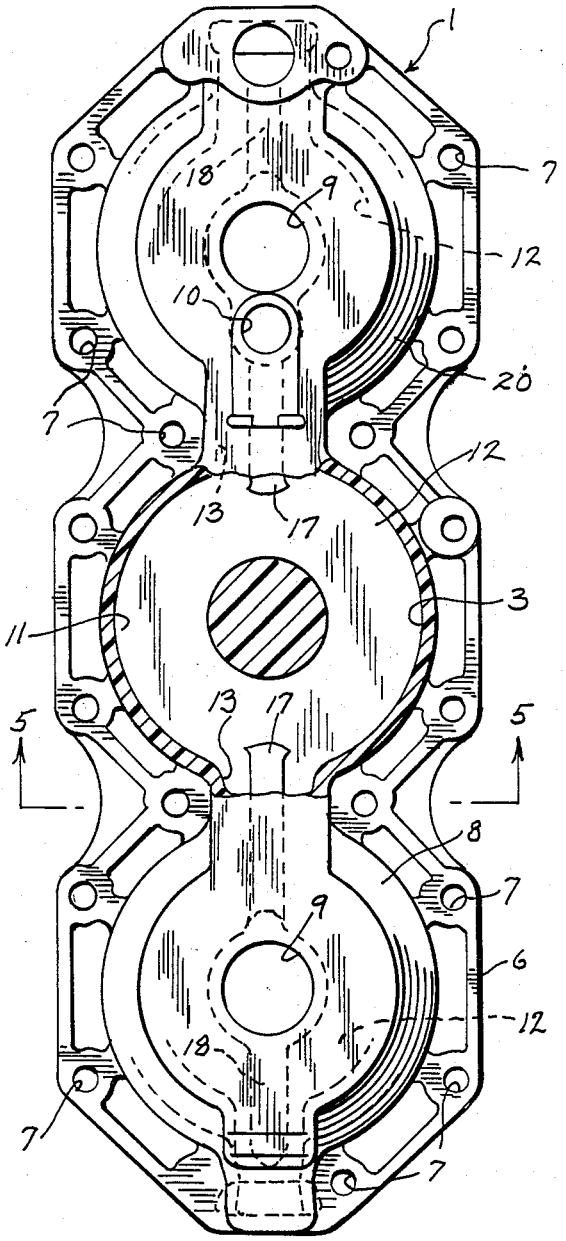
FIG. 2 is a plan view of the outer face of the pattern with parts broken away in section.
Figure 3:
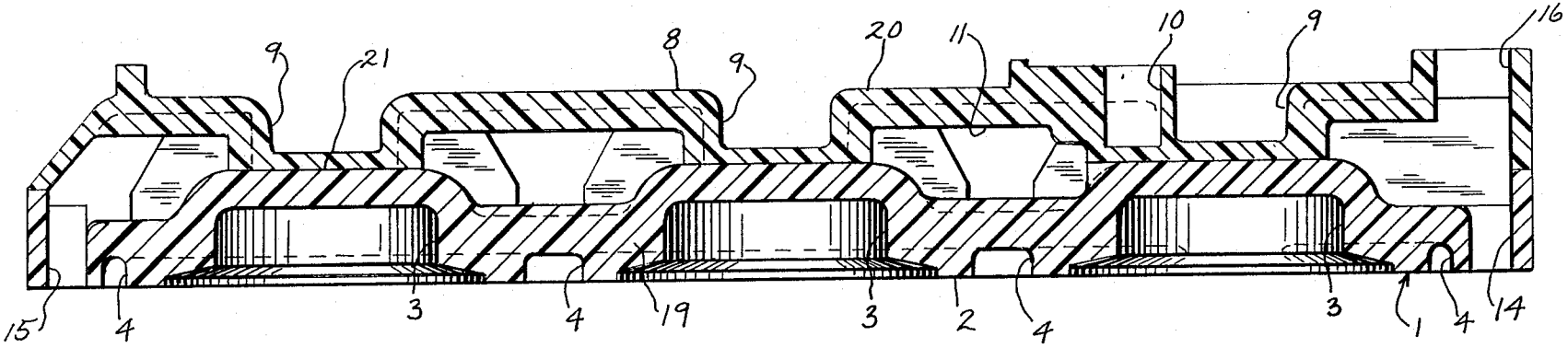
FIG. 3 is a longitudinal section of the pattern taken along line 3—3 of FIG. 1.
Figure 5:
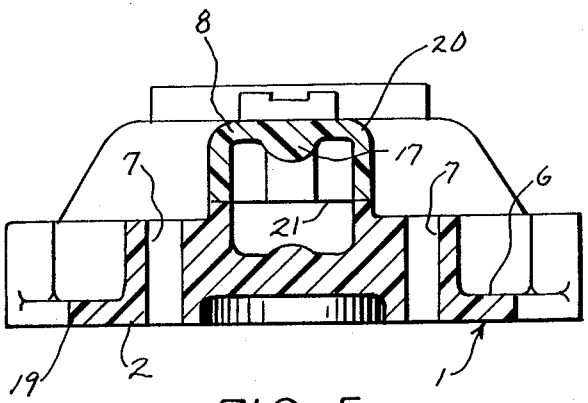
FIG. 5 is a transverse section taken along line 5—5 of FIG. 2.

Pattern 1 includes an inner generally flat face 2 which is formed with a plurality of spaced recesses 3 which in the cast metal part define the cylinder heads. In addition, face 2 is formed with a shallow recess 4 which surrounds the head recesses 3, and as shown in FIG. 1, the recess 4 is provided with a pair of interruptions 5 which are located on opposite sides of one of the head recesses 3.

Pattern 1 is formed with a peripheral flange 6 having a plurality of holes 7, which in the cast metal part, receive bolts to attach the head to the engine block.

Figure 4:
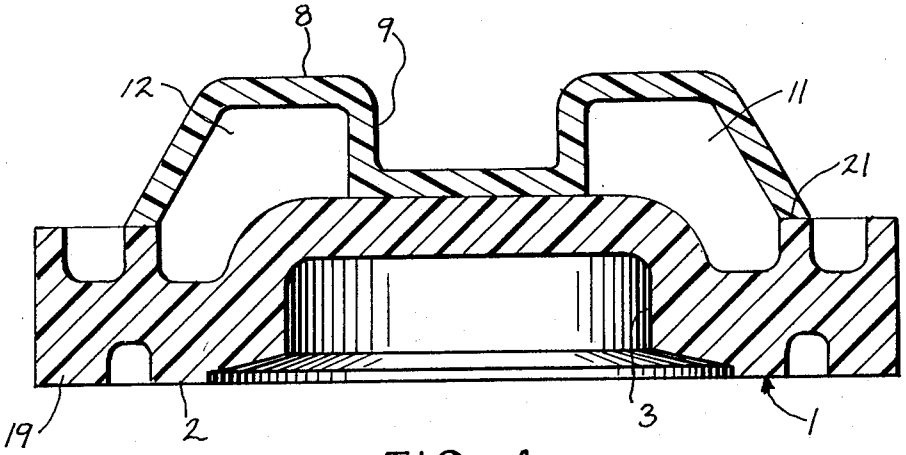
FIG. 4 is a transverse section taken along line 4—4 of FIG. 1.

The outer face 8 of pattern 1 is provided with a plurality of spaced generally cylindrical wells 9 which are aligned with the head recesses 3. As shown in FIG. 4, walls 9 have a smaller diameter than recesses 3 and, in the cast metal part, spark plugs are located in the walls 9 and extend through tapped holes to the cylinder. In addition, outer face 8 is provided with a pocket 10 which extends partially through the pattern and is located adjacent one of the walls 9. In the cast metal head, pocket 10 receives a temperature sensor.

Pattern 1 has an internal passage 11 which in the cast metal part serves as a cooling water passage. Passage 11 includes 3 annular chambers 12 which border the head recesses 3 and adjacent chambers 12 are connected together by channels 13.

Pattern 1 is provided with an inlet opening 14 which communicates with one end of passage 11 and an outlet opening 15 which communicates with the opposite end of the passage. In the metal casting, water is adapted to be introduced into the passage 11 through inlet 14 from the engine block and is returned through outlet 15 to the engine block.

In addition, pattern 1 is formed with an opening 16 which is located in alignment with inlet 14, and in the cast metal part, opening 16 is adapted to be enclosed by a plug.

A rib or bead 17 extends inwardly from each outermost well 9 through the respective channel 13 and similarly a rib 18 extends longitudinally outward from each outermost well 9 and one of the ribs 18 terminates adjacent the inlet 14 while the other rib 18 terminates adjacent the outlet 15. Ribs 17 and 18 serve to stiffen the cast metal head, and during casting, provide metal flow paths.

In accordance with the invention, pattern 1 is formed of a pair of evaporable foam pattern sections 19 and 20 having abutting surfaces which are joined together along the parting line indicated by 21. The abutting surfaces are joined together by a glue or adhesive of the type commonly used in evaporable foam casting processes. During casting, the adhesive will vaporize under the heat of the molten metal and the vapor will be trapped within the interstices of the sand so that there will be no adhesive residue in the cast metal part.

With the pattern construction of the invention, the head recesses 3 are all located in the inner pattern section 19 as are the inlet 14 and outlet 15. This insures that proper tolerance will be maintained between the heads and insures proper registry with the cylinders and water passages of the engine block.

In fabricating the pattern 1, the two evaporable foam pattern sections 19 and 20 are individually cast and are then joined together by applying the adhesive layer along the abutting surfaces on parting line 21. The pattern sections can be held within a suitable fixture during the adhesive bonding operation.

The assembled pattern is then immersed in a ceramic wash liquid and the pattern is designed so that the wash will thoroughly coat all of the internal and external surfaces and drain from the pattern as the pattern is removed from the wash tank.

In the casting operation, the pattern is placed in a mold and a flowable material, such as sand, is introduced into the mold around the pattern. The sand will freely flow into the internal cavities of the pattern.

A molten metal, such as an aluminum alloy, is then introduced into contact with the pattern via a sprue and the heat of the molten metal will vaporize the pattern, as well as the adhesive layer, with the vapor being trapped within the interstices of the sand and the molten metal filling the voids created by vaporization of the pattern and adhesive. This results in a cast metal part which is identical in configuration to the pattern.

With the use of the pattern of the invention, the entire head, including the water cooling passages can be cast as an integral structure. This eliminates the machining, drilling and tapping operations, as well as connecting components, i.e. gaskets and bolts, that were previously required when forming the head of two separate metal sections. Thus, the invention not only reduces the labor cost, but also the material cost for the engine.

As the entire head is formed as an integral structure, it is not necessary to provide increased section thickness to accommodate gasketed surfaces, and this reduces the amount of metal and the weight of the head.

The pattern is designed to improve the heat transfer in the cast metal head by providing more uniform wall thickness between the head recesses and the cooling passages.

Various modes of carrying out the invention are contemplated as being within the scope of the following claims particularly pointing out and distinctly claiming the subject matter which is regarded as the invention.

We claim:

1. An evaporable foam pattern for producing a cast metal cylinder head for a multi-cylinder engine, the assembled pattern comprising an elongated block of evaporable foam material having an inner face and an outer face, a plurality of generally cylindrical head recesses disposed in said inner face and defining in the metal casting the heads for a plurality of cylinders, internal passage means disposed in said block and surrounding said recesses, inlet means connected to said passage means, outlet means connected to said passage means, said assembled pattern composed of a pair of longitudinal pattern sections having abutting surfaces, said abutting surfaces disposed generally parallel to said inner and outer faces, said recesses disposed solely in a first of said sections, and means for joining the abutting surfaces.

2. The pattern of claim 1, wherein said passage means comprises a plurality of generally annular chambers, each chamber disposed concentrically outward of a corresponding head recess, said passage means also including a channel interconnecting adjacent chambers.

3. The pattern of claim 1, wherein said inlet and outlet are disposed in said first pattern section.

4. The pattern of claim 2, and including a rib disposed longitudinally within each channel, said rib being connected to said second section.

5. The pattern of claim 3 wherein said inlet is at one end of said passage means and the outlet is disposed at the opposite end of said passage means.

6. The pattern of claim 2, wherein said outer face of said second section has a plurality of depressions each aligned with one of said head recesses, the bottom of each depression disposed in engagement with the bottom of a corresponding recess along said parting line.

7. The pattern of claim 6, wherein the depressions have a smaller diameter than the recesses.

8. The pattern of claim 1, wherein said joining means comprises an adhesive.

9. An evaporable foam pattern for producing a metal cast cylinder head for a multi-cylinder engine, the assembled pattern comprising an elongated block of an evaporable foam material having an inner face and an outer face, a plurality of generally circular recesses disposed in said inner face and defining in the metal casting the heads of a plurality of cylinders, the inner end of each recess being enclosed by a bottom, internal passage means disposed within the block and including a plurality of generally annular chambers, each chamber being disposed concentrically outward of a corresponding recess, said passage means also including a channel interconnecting adjacent chambers, inlet means connected to one end of said passage means, outlet means connected to the opposite of said passage means, said assembled pattern composed of a pair of longitudinal sections having abutting surfaces, said abutting surfaces being generally parallel to said inner and outer faces, said recesses disposed solely in one of said pattern sections, said sections in combination defining said passage means, and a layer of adhesive joining said abutting surfaces of said pattern sections.

10. The pattern of claim 9, wherein said outer face has a plurality of wells each aligned with a head recess, the inner end of each well enclosed by a bottom, the bottom of each well disposed in engagement with the bottom of a corresponding head recess along said parting line.

11. The pattern of claim 10, wherein said wells have a smaller diameter than said recesses.

12. The pattern of claim 10, and including a rib connected to at least one of said wells and disposed longitudinally in an adjacent channel, said wells and said rib being disposed on the other of said pattern sections.

* * * * *